United States Patent [19]

Iona

[11] 4,092,238

[45] May 30, 1978

[54] PROCESS FOR PRODUCING LOW DENSITY LOW-SULFUR CRUDE OIL

[76] Inventor: Mario Iona, Via Boscovich 55, Milan, Italy

[21] Appl. No.: 743,443

[22] Filed: Nov. 19, 1976

[51] Int. Cl.[2] ..... C10G 37/00

[52] U.S. Cl. ..... 208/80; 208/86; 208/93

[58] Field of Search ..... 208/80, 86, 93

[56] References Cited

U.S. PATENT DOCUMENTS

| | | | |
|---|---|---|---|
| 2,875,149 | 2/1959 | Beavon | 208/86 |
| 2,917,551 | 12/1959 | Leffer | 208/107 |
| 2,932,611 | 4/1960 | Scott et al. | 208/80 |
| 3,736,249 | 5/1973 | Lawson | 208/80 |

*Primary Examiner*—Herbert Levine
*Attorney, Agent, or Firm*—Guido Modiano; Albert Josif

[57] ABSTRACT

Process for producing low density low-sulfur crude oil as feedstock to refinery processes in which a high density, starting crude oil is divided into a base stream and a dilution stream. The dilution stream is separated into a straight run light fraction, at least a medium fraction and an asphaltic residue. At least the medium fraction is subjected to hydrocracking. The hydrocracked fraction and the light fraction are mixed with the base stream and a crude oil of low density and low sulfur content is recovered.

6 Claims, 2 Drawing Figures

PROCESS FOR PRODUCING LOW DENSITY LOW-SULFUR CRUDE OIL

BACKGROUND OF THE INVENTION

This invention relates to a process for producing low density, low-sulfur crude oils from naturally occurring crudes.

It is known that petroleum crudes are traded on the international market by volume (e.g. U.S. barrels, 1 barrel being equal to 158,984 liters) and the lower is their density and sulfur content the more they are valuable crudes.

This because to crudes of lower density there correspond higher yields of more valuable products (gasoline, gas oil, etc., which have a lower density than the starting crude) which justifies therefore for refiners a higher cost of the crudes.

Furthermore, at a lower sulfur content a minor desulfuration requirement for refiners exists, who have to meet legal or commercial limits of sulfur content in finished products, and this will lead substantially to a lower operative cost for refiners.

Heretofore, the much diversified naturally occurring petroleum crudes have been marketed as just extracted, with only a previous decantation processing for removing any water content, and sometimes a previous stabilization processing for removing a possible excess of uncondensable gases.

Due to their enormous diversification as to chemical composition, the naturally occurring crudes are not always suitable for any potential refiner since they cannot provide the desired yields of valuable products or require for the purpose additional and expensive equipments with which only the major worldwide refineries are endowed.

This fact negatively influences the production of certain petroleum producers who have to limit the output to only reduced marketable amounts.

This is all the more so when a crude oil is of heavy type, i.e. of high density (or low API gravity); that is the crude has a high content of hydrocarbons boiling above 662° F, which hydrocarbons result in a lower yield of more valuable finished products.

SUMMARY OF THE INVENTION

An object of this invention is to provide a process for reducing the density and sulfur content of naturally occurring crudes according to the most various requirements of the market and to produce crude oils suitable as feeds to any simple refinery.

Another object of this invention is to provide a process for producing low density low-sulfur crude oils which is able to be reduced to practice in loco on the petroleum production fields by exploiting as energy source for the processes the natural gas widely available in such fields and often flared or dispersed.

Another object of this invention is to provide a process for reducing the density and sulfur content of crude oils without appreciable losses in the total volume of the involved crudes.

Another object of this invention is to provide a process for producing low density low-sulfur crudes which can be easily carried out in conventional and readily available plants.

According to this invention there is provided a process for producing low density low-sulfur crude oil as feedstock to refinery processes comprising:

(a) dividing a high density, starting crude oil into a base stream and a dilution stream,
(b) separating the dilution stream into a straight run light fraction, at least a medium fraction and an asphaltic residue,
(c) hydrocracking said at least a medium fraction,
(d) mixing said hydrocracked fraction and said light fraction with the base stream and recovering a crude oil of low density and low sulfur content.

BRIEF DESCRIPTION OF THE DRAWINGS

Further characteristics and advantages of this invention will be readily evident from the following description given with reference to the accompanying drawing in which.

DESCRIPTION OF THE PREFERRED EMBODIMENTS

Figure 1:
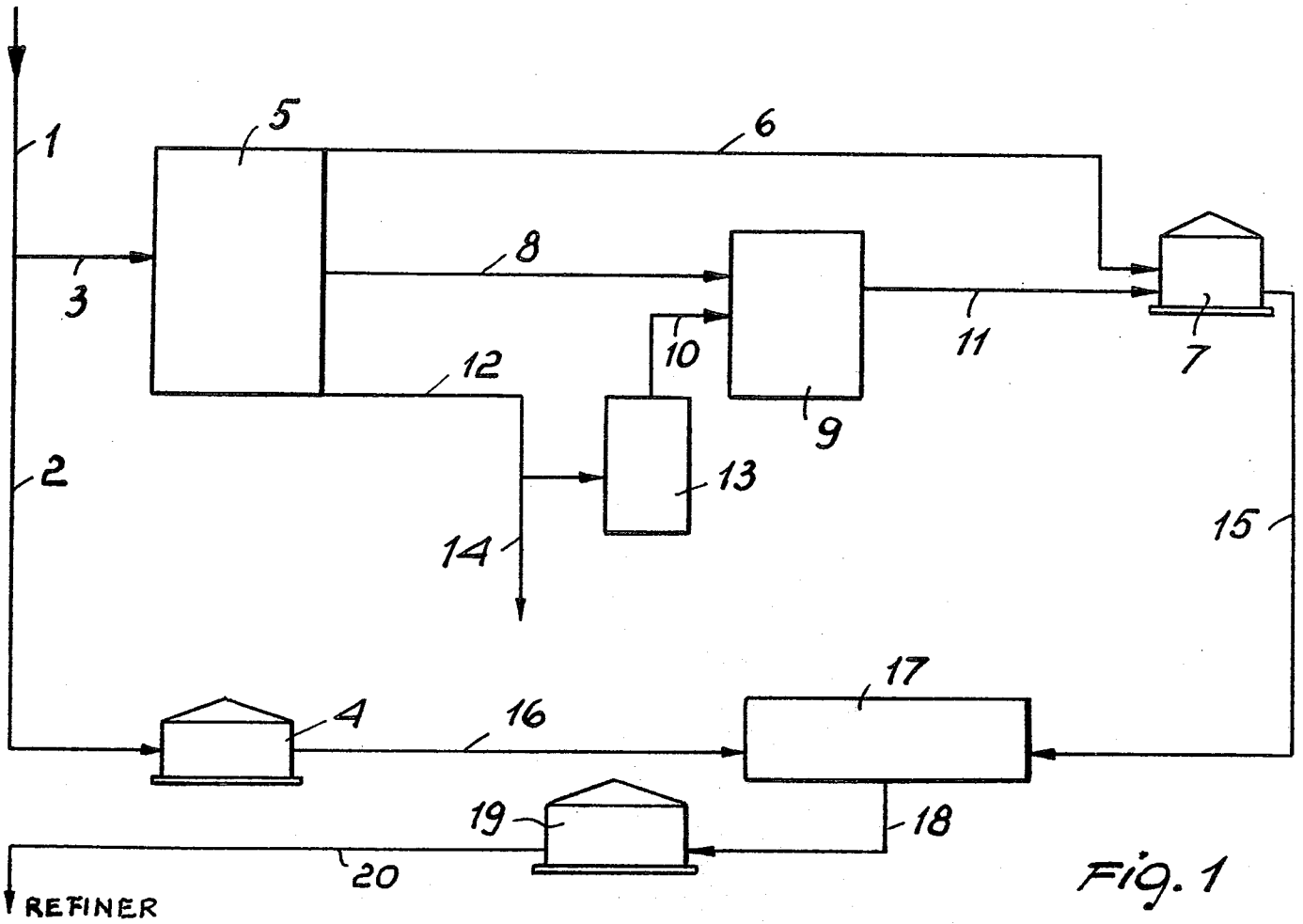
FIG. 1 is a flow sheet illustrating schematically a preferred embodiment of the invention.

Although the process of this invention can be applied to any naturally occurring crude oil, it leads to particular economical advantages if applied to crudes of high density, i.e. low API gravity, say up to a maximum API gravity of 35.

According to the invention, a starting crude oil in line 1 is divided in a base stream in line 2 and a dilution stream in line 3.

The ratio between the base stream and the dilution stream depends obviously on the particular starting crude, and more specifically on its density and sulfur content, and on the characteristics required for the so obtained average crude oil. The higher is the density of the starting crude the greater will be the volume ratio between dilution stream and base stream.

The base stream is stored in a storage tank 4.

The dilution stream in line 3 is conveyed to a separator unit 5 wherein it is subjected to a primary separation step to obtain a light straight run fraction, at least a medium fraction and an asphaltic residue. The light fraction is in the preferred embodiment a hydrocarbons cut boiling below about 662°-698° F while the medium fraction or fractions comprise hydrocarbons boiling above this range of 662°-698° F.

The primary separation step can be carried out with any one of the conventional techniques usually employed in petroleum fractionation processes. A preferred embodiment of this process step will be discussed herebelow with regard to FIG. 2 of the drawing.

The light fraction as separated in the separator unit 5 is carried through line 6 into a collector reservoir 7. In a modified embodiment of the process of this invention the light fraction can be subjected to desulfurization processing by conventional hydrorefining methods.

The medium fraction separated in the separator unit 5 and conveyed through line 8 is subjected to a processing step directed to reduce the ratio between carbon and hydrogen atoms therein, i.e. to reduce its density by reducing the size of its hydrocarbon components without the production of remarkable amounts of gaseous hydrocarbons. This step is adventageously accomplished by catalytic hydrocracking, in a suitable hydrocracking equipment 9.

The hydrocracking can be carried out by any known method, for example, by a single - or two-stage operation, in fixed or fluid catalyst bed. The hydrogen required for this step is fed to the hydrocracking unit 9 through line 10. During the hydrocracking stage the medium fraction fed to unit 9 undergoes decomposition or cracking into lower size hydrocarbons and hydrogenation of the so cracked compounds with the production of almost totally saturated stable products. An important side effect of the hydrocracking process is the desulfurization of the respective feedstock. The sulfur removal can be very severe in function of the particular processing conditions, i.e. hydrogen rate, pressure, ecc., as known to those skilled in the art.

The hydrocracked fraction from unit 9 is withdrawn through line 11 and sent to the collecting reservoir 7 where it is mixed with the light fraction from line 6.

The hydrogen, which is generally needed in large amounts in hydrocracking processes, is advantageously provided in the process of this invention by the asphaltic residue separated from the dilution stream 3 in the separator unit 5. For this purpose, the asphaltic residue withdrawn through line 12 is conveyed to a gasification step in a gasification unit 13. The gasification method can be anyone of the conventional gasification techniques, for example it can comprise a first stage of synthesis gas manufacture consisting of treating the asphaltic residue with steam at very high temperatures and a second stage of carbon monoxide shift carried out on commercial catalysts and directed to enrich the gas product in hydrogen, i.e. to increase $H_2/CO$ molar ratio in the synthesis gas. Where the hydrogen amount produced in the gasification step does not suffice for supplying all hydrogen required in the hydrocracking step some make up hydrogen could be supplied from sources external to the process of the invention. However, since the process of the invention applies successfully to starting crudes with a certain level of density, as mentioned hereabove, the asphaltic residue separated therefrom generally will usually suffice to supply the required quantity of hydrogen, and occasionally will exceed this requirement. In this latter case the asphaltic residue in excess over that necessary for the production of hydrogen withdrawn through line 14, will be used as fuel where required in the process of the invention.

Advantageously, in the process of the invention the heat energy to various plant facilities is provided by natural gas which is notoriously produced in conjunction with the production of crude oils. In fact, the process of this invention is successfully carried out on petroliferous fields where crudes are produced and it utilizes the cheapest available fuel, i.e. natural gas which otherwise would be generally lost.

The stock in the collecting reservoir 7 resulting from the mixing of the light fraction from line 6 and hydrocracked medium fraction from line 11 constitutes a diluent stream which is admixed with the base stream from the storage tank 4. In this order the diluent stream withdrawn from reservoir 7 through line 15 and the base stream in line 16 are mixed in proportions depending on the particular requirements as to density (and subordinately to sulfur content) of the crude oil to be produced by suitable automatic metering means 17.

Figure 2:
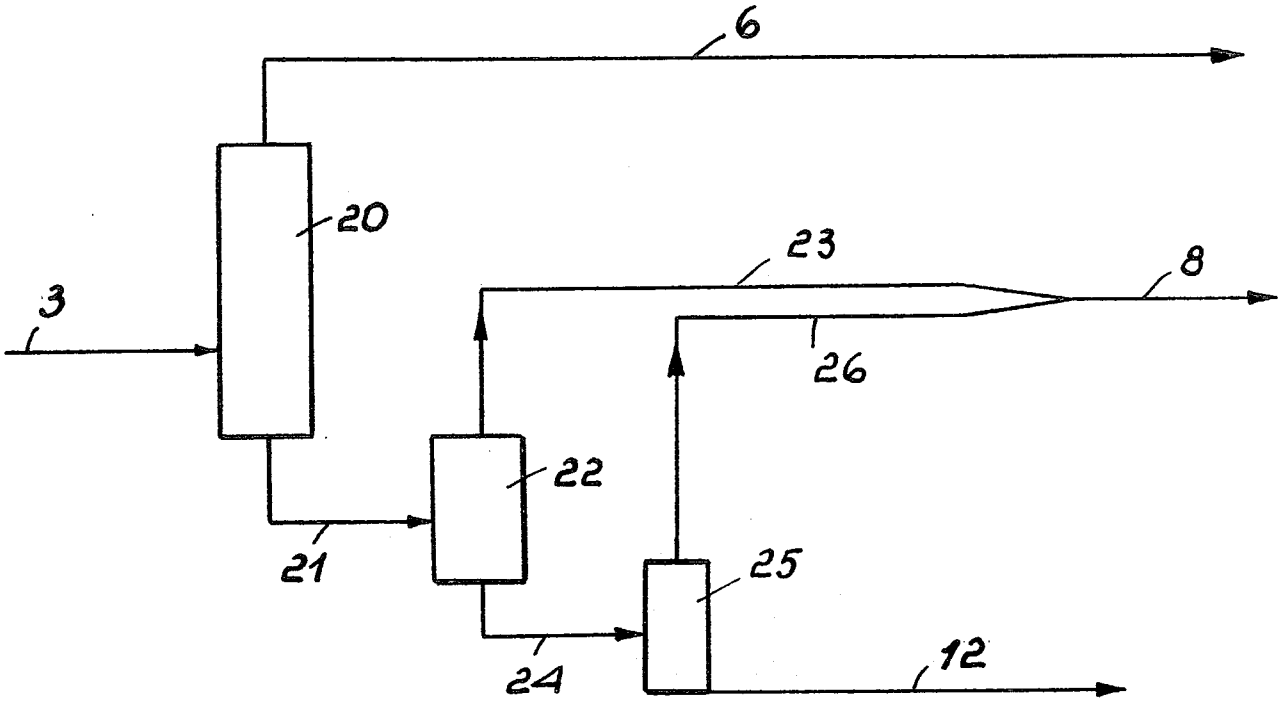
FIG. 2 is a preferred embodiment of a unit of FIG. 1.

The crude oils of reduced density produced is conveyed through line 18 to appropriate containers 19 for storage wherefrom it is sent to consumers on request. Referring now to FIG. 2 of the drawing, there is illustrated a preferred embodiment of the separator unit 5 for carrying out the separation step of the process of the invention.

The dilution stream in line 3 is fed to a flash operation at atmospheric pressure carried out in a first flash tower arrangement 20 wherein solely two fractions separate, i.e. said straight run light fraction boiling below 662°–698° F which is sent through line 6 to the reservoir 7 and a topped crude oil cut boiling above 662°–698° F withdrawn from the flash tower arrangement 20 through line 21. This topped crude oil cut in line 21 is fed to a vacuum flash operation in a second flash tower arrangement 22. The vacuum flash operation is carried out at a vacuum pressure up to about 30–40 mm Hg resulting in a single distillate cut or vacuum flash distillate collected at the top of the second flash tower arrangement 22 in line 23 and an asphaltic containing stock (vacuum residue) at the bottom of the flash tower arrangement 22 withdrawn through line 24. The asphaltic containing stock in line 24 is subjected to a solvent extraction processing in a conventional solvent refining unit 25. In this step a liquified propane, butane or pentane solvent is used for extracting asphalt from the feed stock to unit 25, thus providing an additional amount of asphalt-free hydrocarbon fraction or deasphalted oil in line 26. The vacuum flash distillate from the flash tower arrangement 22 in line 23 and this deasphalted oil in line 26 can be mixed and result in a single medium fraction fed through line 8 to the hydrocracking step in unit 9.

In a modified embodiment of the process of this invention vacuum flash distillate in line 23 and the deasphalted oil in line 26 can be fed separately to the hydrocracking unit 9. In still another modified embodiment the vacuum flash distillate in line 23, and the deasphalted oil in line 26 can be processed in two distinct hydrocracking units. The extracted asphalt from the solvent refining unit 25 is sent through line 12 to the gasification unit 13.

From the foregoing it will be evident that the process of this invention attains all the proposed objects. It allows the conversion of a high density high-sulfur naturally occurring crude in a crude oil of required lower density and lower sulfur content in loco on petroleum extraction field terminals, by employing as heat source cheap natural gas available on these fields or, occasionally, the excess of extracted asphalt.

Moreover the process of this invention results in the production of lighter crude oils without appreciable losses in the total volume of the treated starting crudes and sometimes even with an increase in such volume.

The inventive process can be easily carried out by using conventional techniques and equipement.

The process of the present invention will be better understood from the following example given by way of illustration only.

EXAMPLE 4,000 bbl/day of starting crude oil feedstock having an API gravity of 31.4 (a density of 0.870 kg/liter) and a sulfur content of 2.5% by weight were divided in a base stream, 3.000 bbl/day, and 1.000 bbl/day of dilution stream.

The dilution stream was processed as in the embodiment of the process of the invention shown in FIGS. 1 and 2 of the drawing. Thus, the dilution stream was fed to a separator unit where 528 bbl/day of a straight run light fraction boiling below 670° F separated at the top of an atmospheric flash tower. The balance of the dilution stream at the bottom of the atmospheric flash tower was fed to a vacuum flash tower where 245 bbl/day separated as top vacuum flash distillate, at a pressure of 40 mm Hg. The bottoms from the vacuum flash tower, 227 bbl/day, were subjected to extraction refining with liquefied pentane obtaining an additional amount of 167.3 bbl/day of deasphalted oil and 59.7 bbl/day of asphaltic residue. The vacuum flash distilled and deasphalted oil were mixed together and subjected to hydrocracking processing. All the hydrogen required for this step was supplied by the asphaltic residue by subjecting it to a gasification operation. An amount of 495.4 bbl/day of hydrocracked fraction was recovered from the hydrocracking step and mixed with the previously separated straight run light fraction so obtaining 1023.4 bbl/day of a diluent stream. This diluent stream was characterized by an API gravity of 48.5 corresponding to a density of 0.786 and a sulfur content of 0.5%. By mixing this diluent stream with the base stream, 4023.4 bbl/day of crude oil product were obtained having an API gravity of 35.5 and a sulfur content of about 2.04.

This amount of crude oil product represents about 102% by volume and respectively 93% by weight of the starting crude oil feedstock.

The values reported in this example were obtained without considering corrective factors i.e. without taking into account losses on the plant amounting to about 1% by weight of the reported nominal values.

The foregoing test was repeated by using various percentages of dilution stream referred to the total starting crude oil feedstock (i.e. various ratios between dilution stream and base stream). These percentages and the characterizing API gravity and sulfur content of the obtained crudes are reported in the Table I herebelow.

Although, from theoretical point of view, the diluent stream and base stream can be mixed in any ratio, for practical purposes in accordance to technical requirements of refineries, the crudes produced with the process of this invention can contain a maximum of about 50–60% by volume of diluent stream.

Thus, for example, by using the quantities of the base stream and diluent stream of the example above and using a maximum allowable of diluent stream i.e. about 58% by volume, a crude was obtained characterized by an API gravity of 41.2 and a sulfur content of 1.35. These values are also given in Table I below.

TABLE I

| STARTING CRUDE OIL FEEDSTOCK 31.4 API gravity 2.5 wt. % sulfur | | Crudes Produced With Various Percentages Of Dilution Stream To The Total Starting Crude Oil Feedstock | | | |
|---|---|---|---|---|---|
| Practical Quality Of Crude Oil Produced With Maximum Allowable Diluent Stream | | volume % dilution stream | Average quality of crude oil produced from total dilution stream with total base stream | | Minimum percentage of base stream, referred to the total starting crude oil, which is to be used as such for producing the balance with maximum allowable of diluent stream[1] |
| API gravity | wt. % sulfur | | API gravity | wt. % sulfur | |
| 41.2 | 1.35 | 20 | 34.6 | 2.13 | 66.66 |
| | | 25 | 35.5 | 2.04 | 58.33 |
| | | 30 | 36.3 | 1.94 | 50.00 |
| | | 35 | 37.1 | 1.84 | 41.67 |

[1]that is with 41.2 API gravity and 1.35 wgt % sulfur

I claim:

1. A substantially quantitative process for converting naturally occurring heavy oils having API gravities up to 35, into low density crude oil of low sulfur content which comprises the steps of:

(a) dividing a high density, starting crude oil into a dilution stream and a base stream, the volume ratio of the dilution stream and a base stream, the volume ratio of the dilution stream to the base stream being about 25 to about 60 percent of the total;

(b) separating the dilution stream into a straight run light fraction boiling below about 662°–698° F., a medium fraction boiling above about 662°–698° F., and an asphaltic residue;

(c) hydrocracking said medium fraction;

(d) mixing said hydrocracked fraction and said light fraction, the volumetric sum of said straight run light fraction and said hydrocracked fraction being at least equal to the volume of the original dilution stream; and (e) combining the product from step (d) with the base stream to produce a crude oil having a lower density and a lower sulfur content than the starting crude oil.

2. A process as claimed in claim 1, comprising a step of subjecting the asphaltic residue from step (b) to a gasification processing, recovering hydrogen and using the hydrogen as feed to step (c).

3. A process as claimed in claim 1, wherein step (b) comprises flashing the dilution stream at atmospheric pressure for recovering said straight run light fraction, vacuum flashing the balance of the dilution stream at a pressure of about 30–40 mm Hg for recovering a vacuum flash distillate forming a medium fraction and asphalt-containing bottoms, and solvent extracting said bottoms for recovering a deasphalted oil forming an additional portion of the medium fraction and an asphaltic residue.

4. A process as claimed in claim 3, wherein said first and second medium fraction are mixed before feeding to the hydrocarbon processing of step (c).

5. A process as claimed in claim 3, wherein said first and second medium fractions are fed separately to step (c).

6. A process as claimed in claim 1, wherein the heat supply to the steps (a), (b) and (c) is provided by the natural gases produced in conjunction with the production of the starting crude oil, by a portion of the extracted asphaltic residue, or by a combination thereof.

* * * * *